US007983607B2

(12) United States Patent
Katayama

(10) Patent No.: US 7,983,607 B2
(45) Date of Patent: Jul. 19, 2011

(54) IMAGE FORMING APPARATUS HAVING AN ENDLESS CONVEYING BELT WITH A 720 DEGREE TWIST

(75) Inventor: Hiromasa Katayama, Toride (JP)

(73) Assignee: Canon Kabushiki Kaisha (JP)

( * ) Notice: Subject to any disclaimer, the term of this patent is extended or adjusted under 35 U.S.C. 154(b) by 371 days.

(21) Appl. No.: 12/207,486

(22) Filed: Sep. 9, 2008

(65) Prior Publication Data

US 2009/0067896 A1 Mar. 12, 2009

(30) Foreign Application Priority Data

Sep. 11, 2007 (JP) ..... 2007-234867

(51) Int. Cl.
*G03G 15/00* (2006.01)

(52) U.S. Cl. ..... 399/303; 399/401

(58) Field of Classification Search ..... 399/303
See application file for complete search history.

(56) References Cited

U.S. PATENT DOCUMENTS

| | | | | |
|---|---|---|---|---|
| 3,280,995 | A * | 10/1966 | Barkley | 414/405 |
| 3,726,386 | A * | 4/1973 | Chisholm | 198/405 |
| 4,690,268 | A * | 9/1987 | Ueshin | 198/399 |
| 6,212,351 | B1 * | 4/2001 | Kawagoe et al. | 399/302 |
| 6,356,733 | B1 * | 3/2002 | Hino et al. | 399/303 |
| 6,626,103 | B2 * | 9/2003 | Neumann | 101/230 |
| 6,871,036 | B2 * | 3/2005 | Asuwa et al. | 399/302 |

FOREIGN PATENT DOCUMENTS

JP 2006-103855 A 4/2006

* cited by examiner

*Primary Examiner* — David M Gray
*Assistant Examiner* — David Bolduc
(74) *Attorney, Agent, or Firm* — Rossi, Kimms & McDowell LLP

(57) ABSTRACT

An image forming apparatus has a endless conveying belt (50) which conveys a sheet (P) on which an image is to be formed, and is twisted 720 degrees, and a plurality of suspending members which suspend the conveying belt (50). The conveying belt (50) is suspended on the suspending member like a figure of eight, and conveys a sheet (P) by rotation driving of the conveying belt (50).

7 Claims, 11 Drawing Sheets

IMAGE FORMING APPARATUS HAVING AN ENDLESS CONVEYING BELT WITH A 720 DEGREE TWIST

BACKGROUND OF THE INVENTION

1. Field of the Invention

The present invention relates to an image forming apparatus which can form images on both sides of a sheet, and the apparatus includes, for example, a copying machine, a printer, and a facsimile machine.

2. Description of the Related Art

Conventionally, some image forming apparatuses including a copying machine, a printer, a facsimile machine, and the like have a mode in which images are formed on both sides of a sheet (hereinafter, it will be called a double-sided image forming mode).

When images are formed on both sides of a sheet by such double-sided image forming, the sheet is turned over by a sheet turning over portion provided in the image forming apparatus, using a switch back method. FIG. 10 shows an explanatory view of a side section of a known sheet turning over portion. Operations for turning over processing of a sheet will be described referring FIG. 10.

When a sheet is conveyed from a conveying path 101 to a conveying roller 102, a switching member 108 provided in a branch portion of the conveying roller 102 is rotated to open a conveying path 104 and to close the side of a conveying guide 103. Thereby, the sheet is conveyed to the conveying path 104 by the rotation of the conveying roller 102.

As a switching member 109 provided in the branch portion of a turning over roller 105 closes a conveying guide 110 when the sheet is conveyed to the conveying path 104, the sheet passes the conveying path 104, and is sent off to a sheet turning path 107 by the turning over roller 105. The turning over roller 105 stops when the rear end of the sheet passes the switching member 109.

When the turning over roller 105 stops, the switching member 109 closes the conveying path 104 to open the conveying path 110. The turning over roller 105 sends off the sheet to the conveying guide 110 by reversing the direction of rotation, and the sheet is conveyed as it is, by a conveying roller 106 to the image forming portion through a both-sided conveying path.

In the conventional sheet turning over apparatus using a switch back method as described above, a roller for switching back a sheet has to be stopped and reversed when a sheet is turned over, which wastes time.

Moreover, when a sheet is switched back, the sheet is temporarily taken into a sheet turning path 107 and the apparatus is occupied with the sheet until the whole sheet passes the guide 110. Thereby, longer paper requires more time to be taken in. Accordingly, it has been difficult to improve the productivity in the double-sided image forming mode.

There has been proposed a method by which a sheet is twisted and turned, as shown in FIG. 11. As shown in FIG. 11, a turning over unit 30 has a structure in which an attracting belt 33 is stretched between a belt drive roller 35, which is a convey starting position, and a belt drive roller 36, which is a convey completing position, while being twisted 180 degrees. The sheet is attracted onto the attracting belt 33 by adding electrostatic force to the attracting belt 33 using an AC power supply 41, and the sheet is conveyed. Thereby, the time required for turning over the sheet is shortened to improve the productivity at the double-sided image forming mode (refer to Japanese Patent Application Laid-Open No. 2006-103855).

However, the method for twistingly turning over requires a space in which a sheet is rotated by 180 degrees and is turned over. Accordingly, the size of an image forming apparatus becomes larger.

Moreover, a sheet conveying speed in an image forming apparatus has been increased in recent years. As a result, behaviors at the end of a sheet become unstable at delivery of a sheet from a roller conveying portion to the subsequent roller conveying portion, and at delivery of a sheet from a roller conveying portion to a belt conveying portion in conventional roller conveying, since roller conveying and belt conveying exist in a complicated manner in a conventional apparatus. As a result, sheet jamming (clogging) occurs which results in unstable sheet conveying.

SUMMARY OF THE INVENTION

The present invention considers the above-described circumstances, and it is for providing a small and compact image forming apparatus which is based on a sheet turning over method, and by which a sheet may be conveyed at high speed in a stable manner.

The present invention in its first aspect provides an image forming apparatus as claimed in claims 1 to 10. The image forming apparatus includes an endless conveying belt configured to convey a sheet on which an image is to be formed by rotation of the conveying belt, and a plurality of suspending members, configured to suspend the conveying belt, wherein the conveying belt is adapted to have a twist of 720 degrees, and is configured to be suspended from the suspending members in a figure of eight arrangement.

The present invention uses a configuration in which a sheet is conveyed on an endless conveying belt which is twisted 720 degrees, and is suspended like a figure of eight. The size of the apparatus can be reduced by transfer conveying using a conveying belt, by turning over conveying, by which a sheet is turned over, and the like.

Moreover, when fixing conveying is also realized by the conveying belt, stable conveying of a sheet may be realized by forming a ring-like conveying path in an image forming apparatus.

Further features of the present invention will become apparent from the following description of exemplary embodiments (with reference to the attached drawings).

DESCRIPTION OF THE EMBODIMENTS

Figure 1:
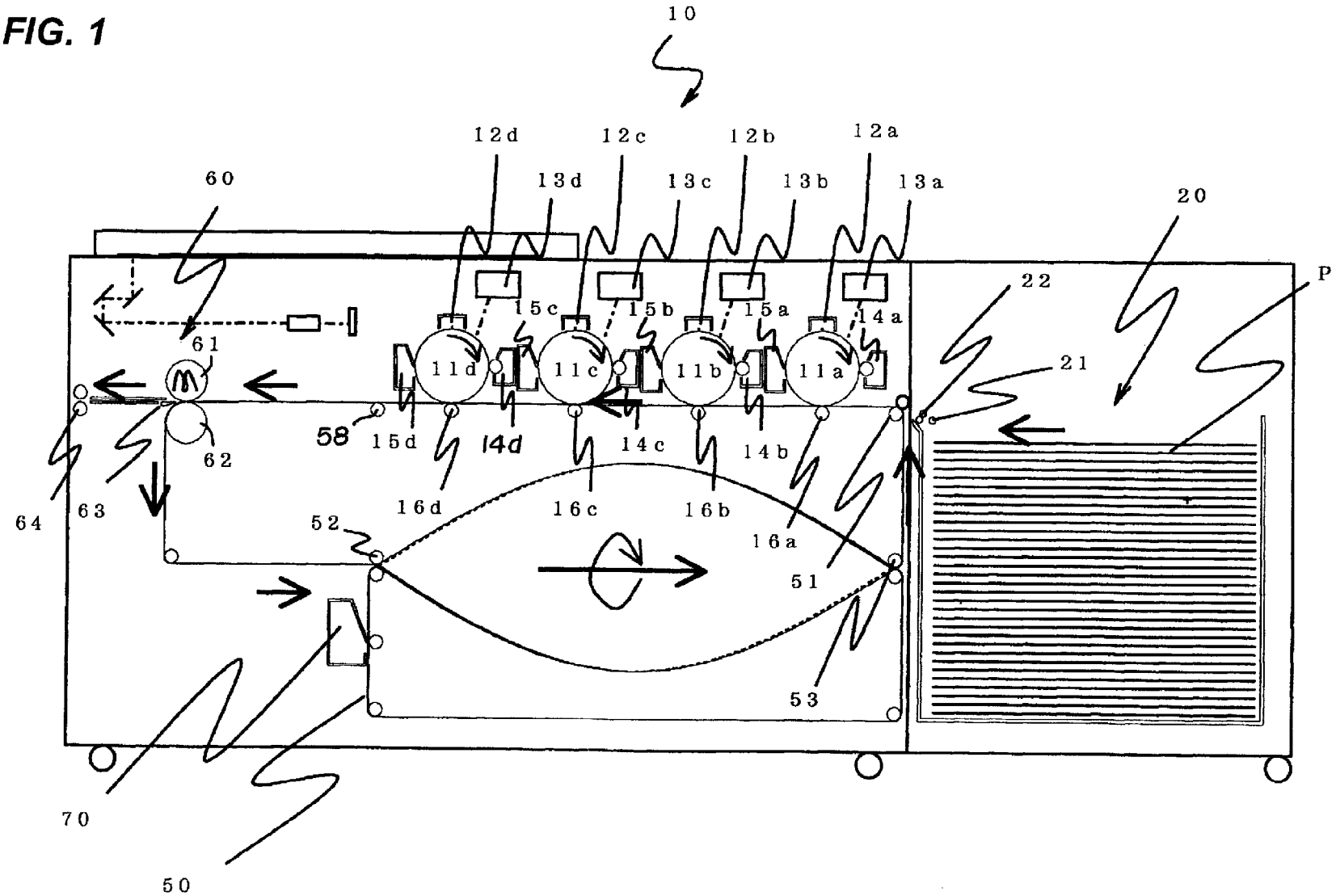
FIG. 1 is a longitudinal and sectional view of an image forming apparatus according to one embodiment of the present invention.
Figure 2:
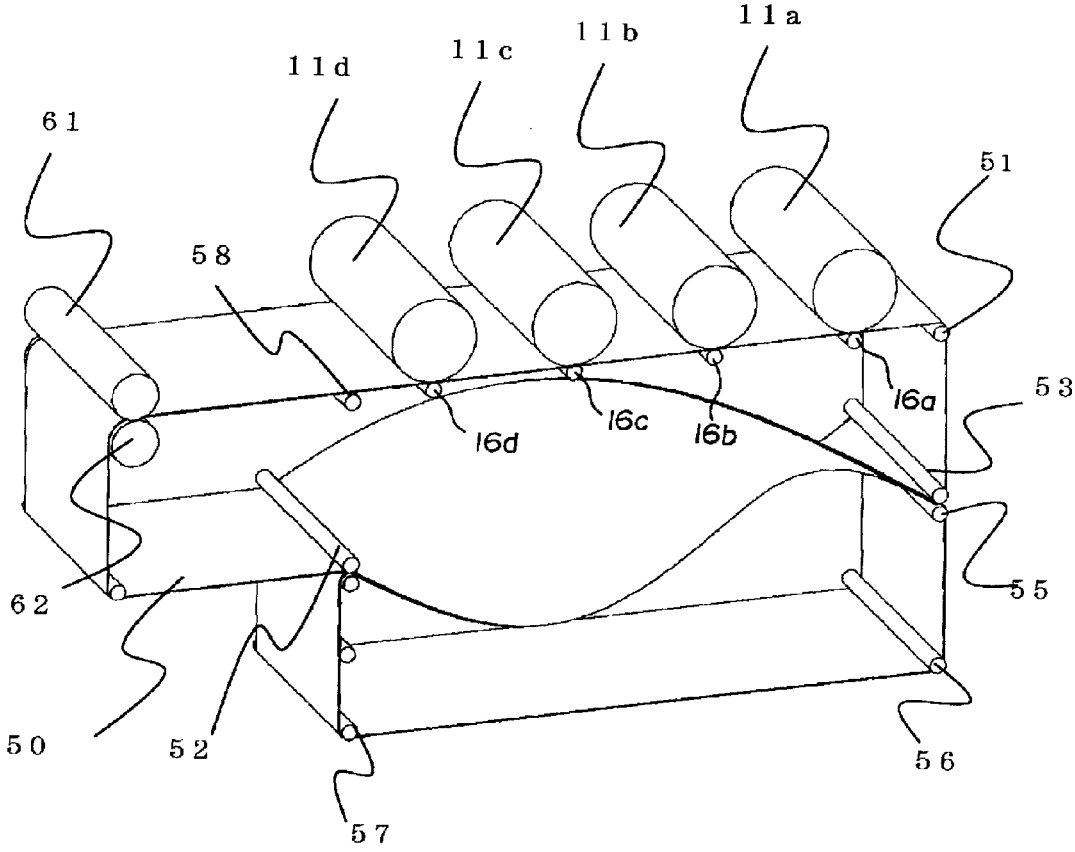
FIG. 2 is a perspective view illustrating a suspended state of a conveying belt illustrated in FIG. 1.

Hereinafter, an embodiment of the present invention will be described in detail, referring to the drawings. Here, FIG. 1 is a schematic longitudinal view of a color image forming apparatus according to an embodiment of the present invention, and shows a state in which a plurality of image forming portions are aligned. FIG. 2 is an explanatory perspective view showing a suspended state of the conveying belt shown in FIG. 1.

First Embodiment

In FIG. 1 and FIG. 2, an image forming portion 10 has a structure in which image bearing members comprising photoconductive drums 11*a*, 11*b*, 11*c*, and 11*d* are driven to rotate in the direction of the arrow in the drawing. Primary chargers 12*a*, 12*b*, 12*c*, and 12*d*, optical systems 13*a*, 13*b*, 13*c*, and 13*d*, and development apparatuses 14*a*, 14*b*, 14*c*, and 14*d* are arranged in the direction of the rotation facing the outer surface of each of the photoconductive drums 11*a* through 11*d*.

Uniform charging amounts of electric charges are given onto the surfaces of the photoconductive drums 11*a* through 11*d* by the primary chargers 12*a* through 12*d*. The optical systems 13*a* through 13*d* perform modulation according to the recorded image signals. Beams such as laser beams are exposed onto the photoconductive drums 11*a* through 11*d* to form electrostatic latent images on each of the photoconductive drums 11*a* through 11*d*.

Then, the electrostatic latent images are made to appear as visible toner images with the development apparatuses 14*a* through 14*d* containing developers (toners) of four colors, that is, yellow, cyan, magenta, and black, respectively. The toner images are transferred one by one on sheets P which have been conveyed by nip portions between the photoconductive drums 11*a* through 11*d* and transfer rollers 16*a* through 16*d*.

The toners left on the photoconductive drums 11*a* through 11*d* which have not been transferred onto the sheet P are removed by cleaning devices 15*a*, 15*b*, 15*c*, and 15*d*, and the surfaces of the photoconductive drums 11*a* through 11*d* are cleaned after image transfer.

The sheets P are stacked in a feeding portion 20, and are conveyed to a pair of resist rollers 22 by a pick up roller 21 sending off the sheets P one by one. A pair of resist rollers 22 sends off the sheet P to the conveying belt 50 according to an image-forming timing. The sheet P sent off by the pair of resist rollers 22 is attracted onto the conveying belt 50 by attracting roller 51.

The sheet P attracted onto the conveying belt 50, which will be described in detail later, is conveyed to the nip portions between the photoconductive drums 11*a* through 11*d* and the transfer rollers 16*a* through 16*d* as described above, and a toner image is transferred onto the sheet P one by one by applying a high voltage to the transfer rollers 16*a* through 16*d*. When an image is transferred onto the sheet P, the sheet P is conveyed by the conveying belt 50, and reaches a fixing portion 60.

The fixing portion 60 fixes an image onto the sheet, and has a fixing roller 61 provided with a heating source such as an internal halogen heater, and a pressing roller 62 (in some cases, the pressing roller 62 is also provided with a heating source) pressed by the above fixing roller 61. The toner image is fixed onto the surface of the sheet P by heat from the pair of rollers 61 and 62 in the fixing portion 60 and by the nipping pressure. The sheet P onto which the toner image is fixed is separated from the conveying belt 50 by a separation claw 63 as a separation means, and is conveyed by a discharging roller 64 to be discharged to the outside.

When both sides of a sheet P are printed, the separation claw 63 is rotated anticlockwise in the figure, and is spaced apart from the conveying belt 50 after a toner image is fixed in the fixing portion 60 as described above. The sheet P is then conveyed to the lower portion of the device.

The conveying path in the lower portion of the device is a both-sided conveying path (re-conveying path), which leads the sheet P to the image forming portion 10 again, and is continuously formed by the conveying belt 50.

When the sheet P reaches a before-turning over roller 52, the sheet P is conveyed in a state in which the sheet P is located between two different parts of the conveying belt which face one another. Then, the sheet P is turned over by being twisted with the conveying belt 50. The sheet P is conveyed again to the image forming portion 10 by an attracting roller 53 by attracting the sheet P onto a part of the conveying belt 50 facing the part of the conveying belt 50 which has conveyed the sheet P so far, after the sheet P is turned over.

Then, an image is formed onto the opposite (second) major surface of the sheet the next time. Furthermore, the sheet is separated from the conveying belt 50 by the separation claw 63 after a toner image on the second surface is fixed in the fixing portion 60, is conveyed by the discharging roller 64, and is discharged to the outside to end one both-side image recording cycle.

Next, a belt configuration according to the present embodiment will be described.

Figure 3:
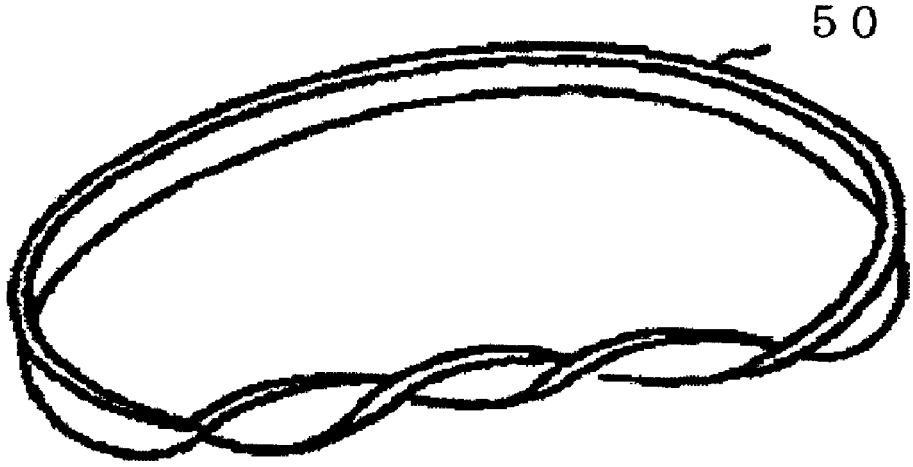
FIG. 3 is a perspective view of a conveying belt according to one embodiment of the present invention.
Figure 4:
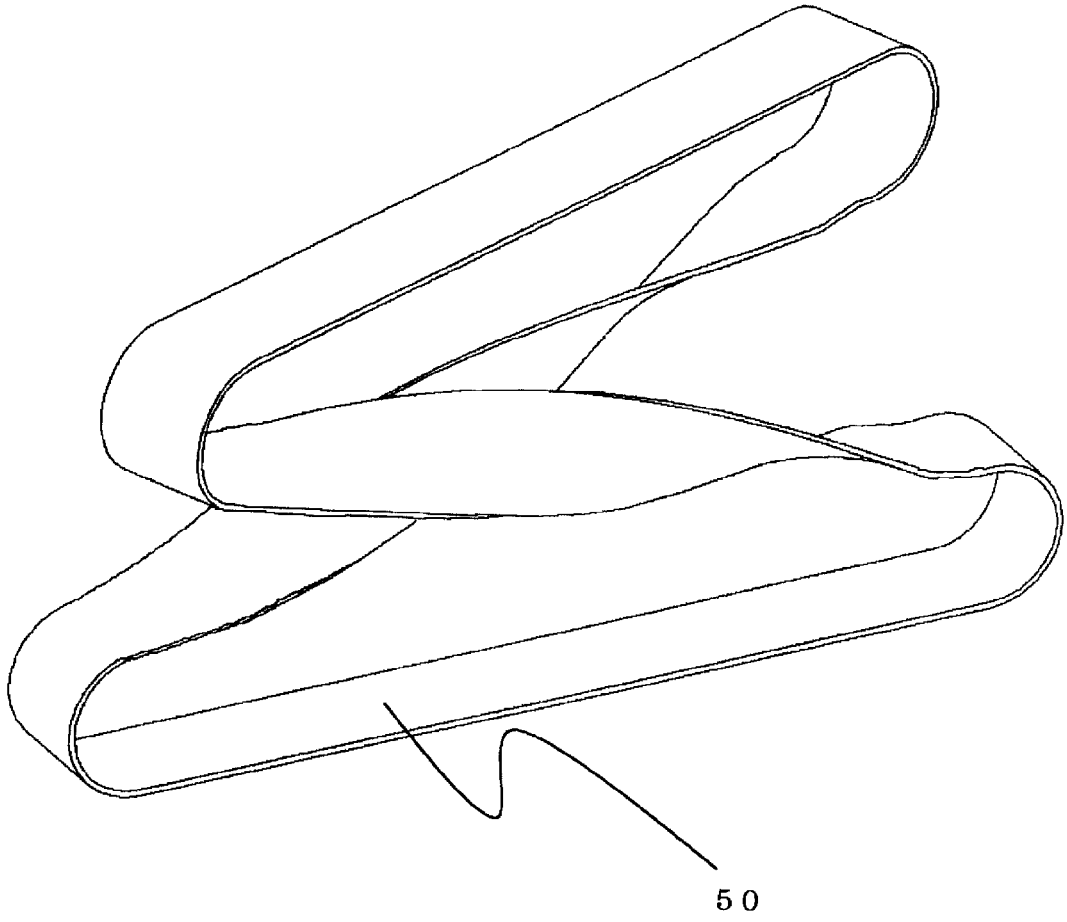
FIG. 4 is a perspective view of a conveying belt, which has a shape of a figure of eight, according to one embodiment of the present invention.
Figure 5:
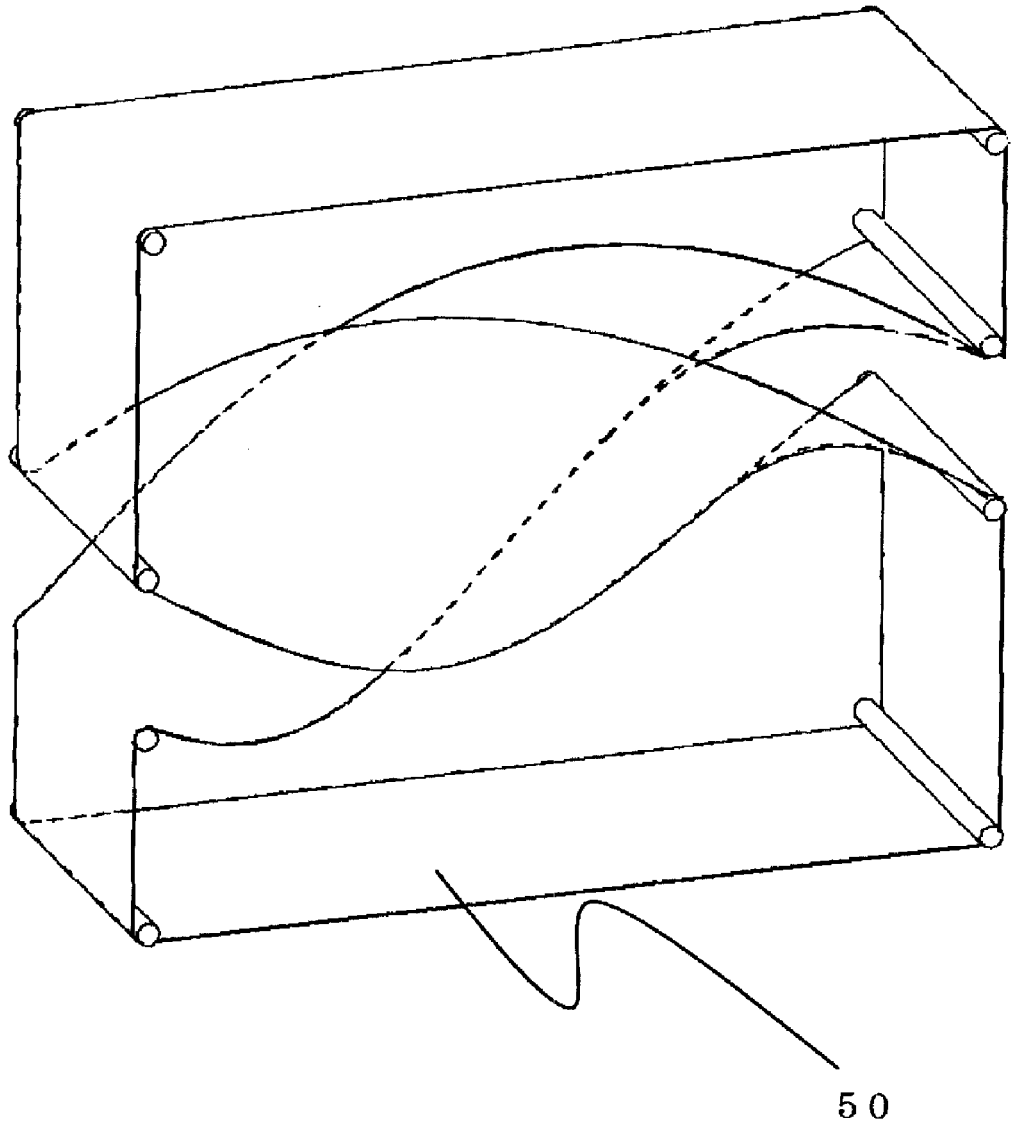
FIG. 5 is a perspective view illustrating a suspended state of the conveying belt illustrated in FIG. 4.

The conveying belt 50 according to the present embodiment has a configuration in which an endless conveying belt, which is twisted 720 degrees as shown in FIG. 3, is suspended like the letter form of eight as shown in FIG. 4 and FIG. 5 and forms a conveying path for the sheet P. The conveying belt preferably comprises a material such as PI (polyimide) or the like. There may be also a configuration in which the above materials are used as a base material, and there may be a layer of rubber such as polyurethane on the surface. In FIG. 2, rollers 55, 56, 57, and 58 are suspending rollers which suspend the conveying belt 50.

A cleaner 70 is arranged adjacent to the conveying belt 50 as a cleaning means for the conveying belt 50. As the cleaner 70 is in a region in which the sheet P is not conveyed by the conveying belt 50, the conveying belt 50 may be cleaned without detaching the cleaner 70 from the conveying belt 50 at any time.

The driving source of the fixing portion 60 is used as the driving source of the conveying belt 50. As the conveying belt 50 is sandwiched between the fixing roller 61 and the pressing roller 62, the conveying belt 50 is rotated too by rotation of the fixing roller 61. The pressing roller 62 in the fixing portion 60 also functions as a suspending member for suspending the conveying belt 50.

Incidentally, rollers are described as the suspending members for the conveying belt 50 in the above embodiment, the suspending means can comprise things other then rollers. For example the suspending means may consist of a guide shaped member having a good slidability (low coefficient of friction). Moreover, the number of the suspending members is not limited, but, there may be a configuration in which the shape and the conveying operation of the conveying belt 50 can be further stabilized when the sheet is conveyed by using additional suspending members.

The attracting roller 51 which is one of the suspending members is biased by a spring (not shown) in the direction in which the roller 51 is separated from the pressing roller 62. Accordingly, the conveying belt 50 from the attracting roller 51 to the pressing roller 62 is suspended with enough tension.

The force attracting the sheet P onto the conveying belt 50 is an electrostatic force. In order to charge the conveying belt 50, to provide the above electrostatic force, the electric charge may be given to the conveying belt 50 by supplying a current to the attracting rollers 51 and 53. Here, the attracting rollers 51 and 53 also function as suspending members suspending the conveying belt 50.

The sheet P conveyed from the feeding portion 20 can be attracted onto the conveying belt 50 by supplying a current to the attracting roller 51. When a conveying path from the feeding portion 20 via the attracting roller 51 to a transfer portion afterwards is almost straight, positive attraction to the conveying belt 50 is not required, and the electrostatic force of the attracting roller 51 is not necessarily required.

Though the sheet P which has been attracted to a first part of the conveying belt 50 is required to be attracted to an opposite part of the conveying belt at the position of the attracting roller 53 after turning over of the sheet P, attraction from the conveying belt 50 at the first part to the opposite part may be achieved by supplying a current to the attracting roller 53.

In order to reduce the attracting force of the first part of the belt, delivery from the first part to the opposite part of the conveying belt 50 at the attracting roller 53 becomes easier by giving a discharging power to the before-turning over roller 52.

Moreover, if the discharging power is given to the suspending roller 58, stable fixing may be obtained because discharging is done before fixing. Moreover, it is easy to separate the sheet P from the conveying belt 50 in order to discharge the sheet P to the outside of the device.

The discharging means is not limited to a suspending member, for example, a discharging needle in contact with the surface of the sheet P may be separately provided. In particular, by providing the discharging needle just after the nip between the fixing roller 61 and the pressing roller 62, it become easier to separate the sheet P from the conveying belt 50.

Usually, rotation driving of a endless belt such as the conveying belt 50 generates belt slippage in which the belt advances in a direction orthogonal to the rotation direction. As a general adjustment for the belt slippage, there are a method in which a rib is provided on a belt to regulate the belt slippage, a method in which the belt slippage is regulated by providing a flange on a suspending member, or a method in which the belt slippage is adjusted by providing a belt-slippage detecting means, and by adjusting the belt slippage of a suspending member. The belt slippage can be adjusted using any of these methods.

In the present embodiment, the conveying belt has a series of steps for sheet conveying, by which, after an image is formed on the surface of the sheet P in an image transfer region, in which there is no twisting, between the attracting roller 51 and the pressing roller 62 on the conveying belt, and the sheet P is subsequently turned over in a twisting region between the before-turning over roller 52 and the attracting roller 53, a further image is then formed on the back of the sheet P. Accordingly, the size of the turning over mechanism of a sheet P may be reduced to contribute to the smaller size of the image forming apparatus. Moreover, jamming and the like is reduced because there is less delivery of the sheet P from roller conveying to belt conveying.

Figure 6:
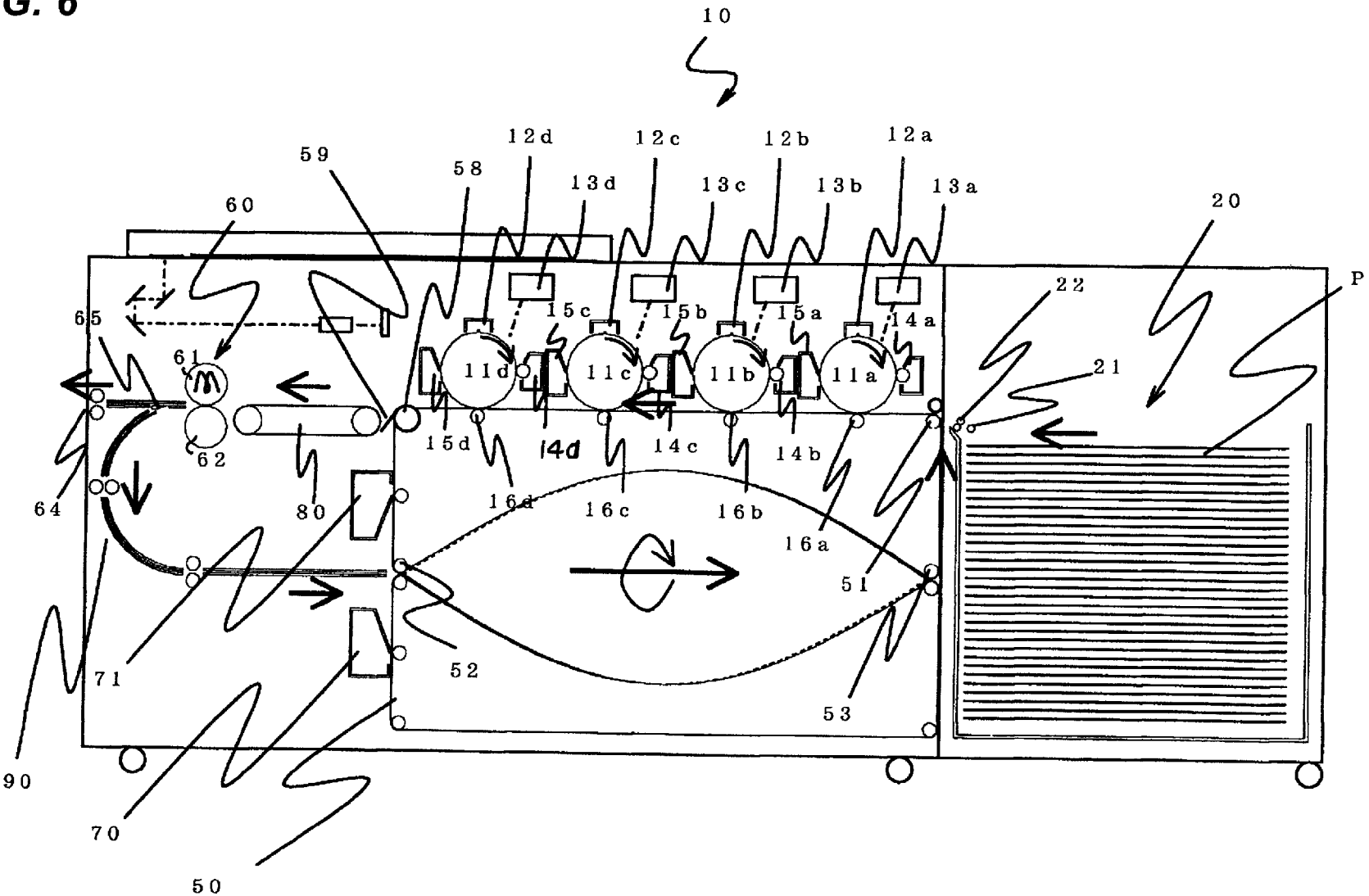
FIG. 6 is a longitudinal view of an image forming apparatus according to another embodiment of the present invention.

In the present embodiment, an example was shown in which the fixing roller 61 is used as the driving source for the conveying belt 50. However, the suspending roller 58, different from the fixing roller 61, may be used as the driving source as shown in FIG. 6. In this case, the sheet P is separated from the conveying belt 50 by a separation means 59 before the fixing portion 60, and is conveyed by a before-fixing conveying portion 80. Furthermore, there may be another configuration in which, after the sheet P passes the fixing portion 60 for both-side printing, the sheet P is configured to pass a bending path 90 by a switching member 65, and the sheet P is attracted again onto the conveying belt 50.

Even in this case, it is possible to obtain the advantage of a smaller device, and the conveying belt 50 may be cleaned with a cleaner 71 after a toner image is transferred onto the sheet P, and before the sheet P passes the fixing portion 60.

Second Embodiment

Figure 7:
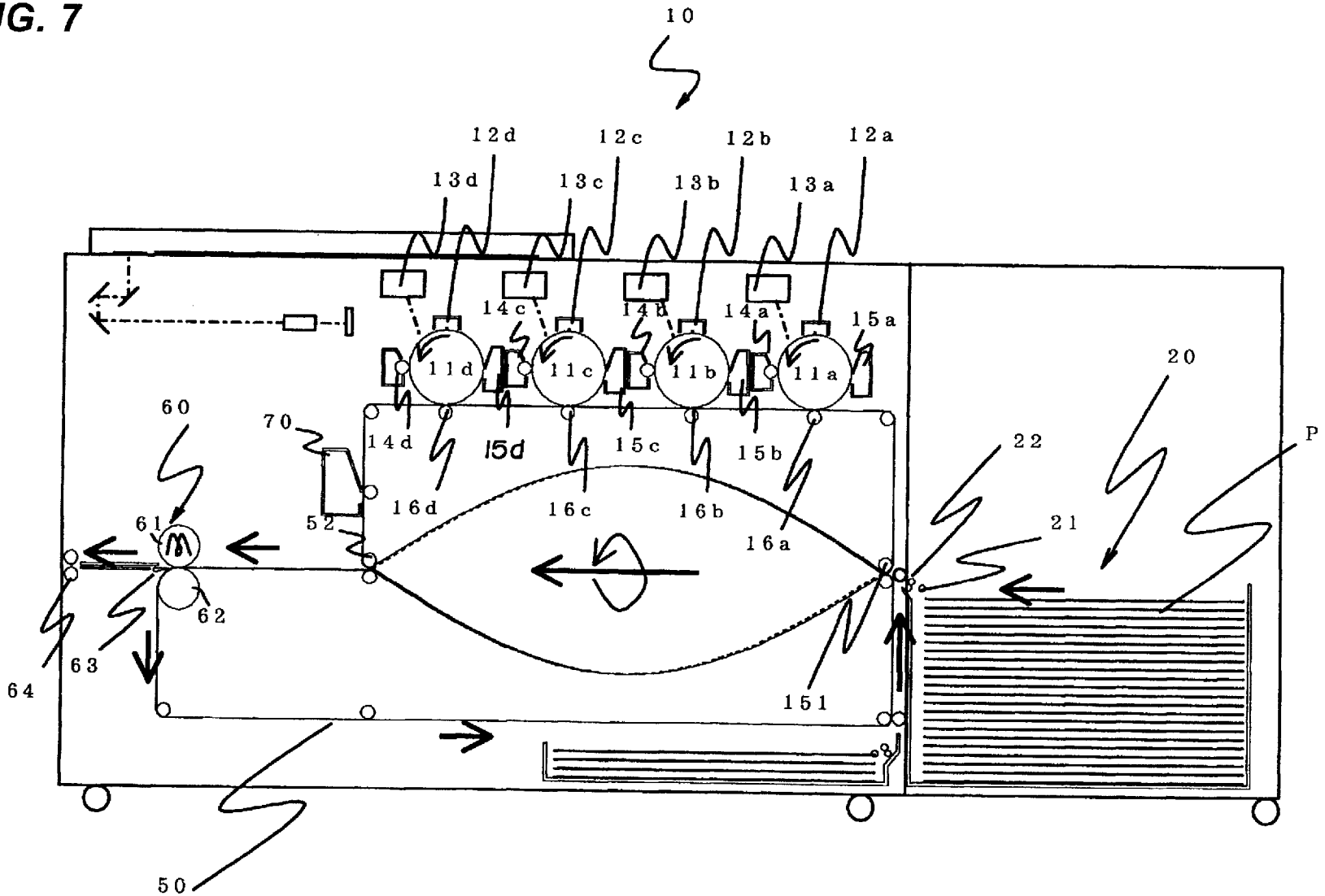
FIG. 7 is a longitudinal view of an image forming apparatus according to further another embodiment of the present invention.

The image forming apparatus shown in FIG. 7 is a color image forming apparatus including a plurality of image forming portions.

In the image forming portion 10, the photoconductive drums 11*a*, 11*b*, 11*c*, and 11*d*, are driven to rotate in the direction of the arrow in the drawing. The primary chargers 12*a*, 12*b*, 12*c*, and 12*d*, the optical systems 13*a*, 13*b*, 13*c*, and 13*d*, and the development apparatuses 14*a*, 14*b*, 14*c*, and 14*d* are arranged in the direction of the rotation facing the outer surface of each of the photoconductive drums 11*a* through 11*d*.

Uniform charging amounts of electric charges are given onto the surfaces of the photoconductive drums 11*a* through 11*d* by the primary chargers 12*a* through 12*d*. Subsequently, for example, beams such as laser beams modulated by the optical systems 13*a* through 13*d* according to the recorded image signals are directed onto the photoconductive drums 11*a* through 11*d* to form electrostatic latent images on each of the photoconductive drums 11*a* through 11*d*.

The electrostatic latent images are made to appear as toner images with the development apparatuses 14*a* through 14*d* containing developers (toners) of four colors, that is, yellow, cyan, magenta, and black, respectively. The toner images are transferred one by one onto the conveying belt 50 at the nip portions between the photoconductive drums 11*a* through 11*d* and the transfer rollers 16*a* through 16*d*.

The toners left on the photoconductive drums 11*a* through 11*d* without being transferred onto the conveying belt 50 are scraped off by cleaning devices 15*a*, 15*b*, 15*c*, and 15*d*, and the surfaces of the photoconductive drums 11*a* through 11*d* are cleaned. That is, the conveying belt 50 also functions as an intermediate transfer member (intermediate transfer belt) onto which primary transfer of an image is made.

The sheets P are stacked in the feeding portion 20, and are conveyed to a pair of resist rollers 22 by the pick up roller 21 sending off the sheets P one by one. The pair of resist rollers 22 send off the sheets P to the conveying belt 50 according to the image-forming timing. The sheet P sent off by the pair of resist rollers 22 is attracted onto the conveying belt 50 by an attracting roller 151.

As the toner image formed in the image forming portion is conveyed on the conveying belt 50, the sheet P is in pressed into contact with the toner image by the attracting roller 151. Subsequently, the toner image and the sheet P are twisted as one body, and the sheet P is turned over. In a state in which the toner image surface is on the lower part of the conveying belt, the sheet P is conveyed onto the conveying belt 50 as it is, and is directed to the fixing portion 60.

The fixing portion 60 has a fixing roller 61 provided with a heat source such as an internal halogen heater, and a pressing roller 62 (provided with a heat source in the pressing roller 62, in some cases) pressed onto the fixing roller 61. Then, the toner image is transferred and fixed onto the surface of the sheet P at the same time by heat of a pair of rollers 61 and 62 in the fixing portion 60 and by the nipping pressure. The sheet P onto which the toner image is transferred and fixed is separated from the conveying belt 50 by the separation claw 63 which is a separation means, is conveyed by the discharging roller 64, and is discharged to the outside.

When printing is performed on both sides of a sheet P, the separation claw 63 is rotated anticlockwise in the figure, and is left spaced from the conveying belt 50 after an appeared image is fixed in the fixing portion 60 as described above. Thus the sheet P is conveyed to the lower portion of the device.

The conveying path in the lower portion of the device is a both-sided conveying path for leading the sheet P to the image forming portion 10 again, and is continuously formed by the conveying belt 50. Thus the sheet P is conveyed again to the image forming portion 10.

An image is then formed onto a second surface this time as well as the image forming process for the first surface. Furthermore, the sheet is separated from the conveying belt 50 by the separation claw 63 after a second appeared image is fixed in the fixing portion 60, is conveyed by the discharging roller 64, and is discharged to the outside to complete one both-side image recording cycle.

Next, a belt configuration according to the second embodiment will be described.

The shape and the material of the conveying belt 50 according to the present embodiment are similar to those of the first embodiment.

Figure 8:
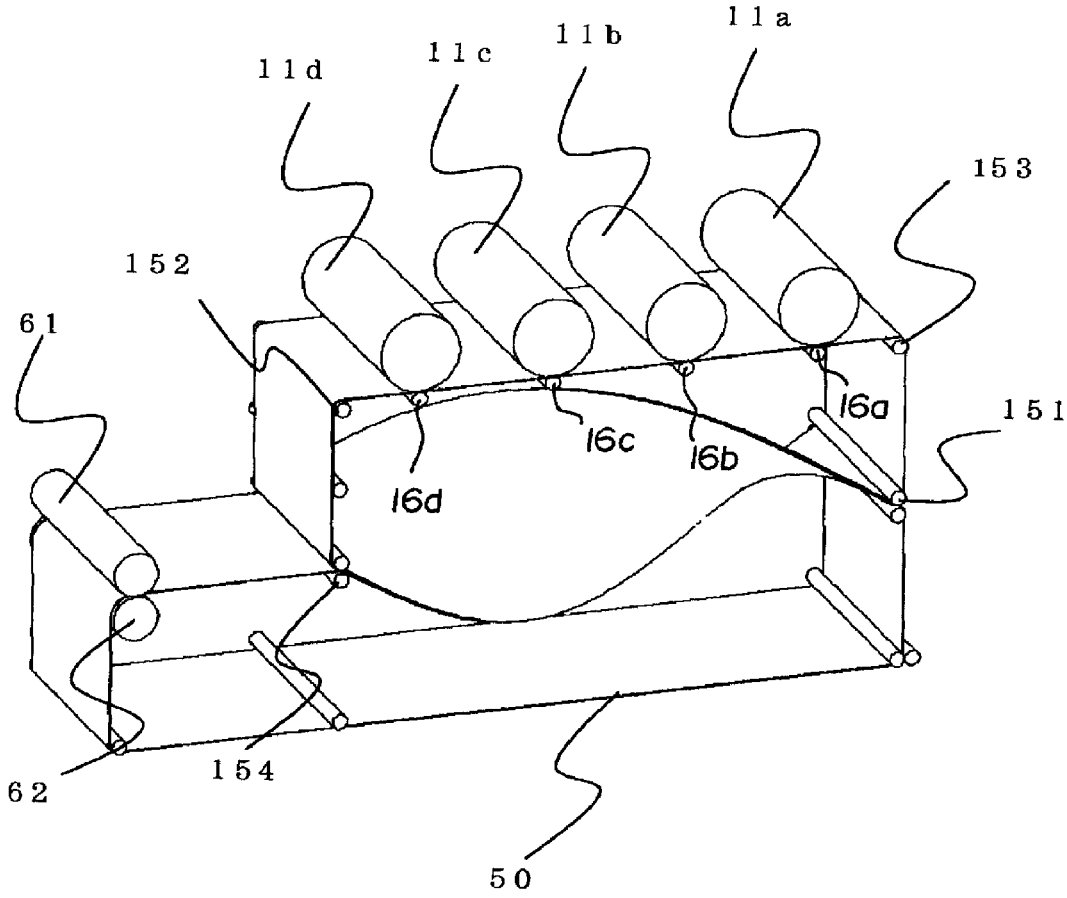
FIG. 8 is a perspective view illustrating a suspended state of the conveying belt shown in FIG. 7.

As shown in FIG. 8 a suspending roller 152 which is one of the suspending members according to a second embodiment is biased by a spring (not shown) in the direction separating from the suspending roller 153. Accordingly, the conveying belt 50 from the suspending roller 152 to the suspending roller 153 is suspended with enough tension.

The force by which the sheet P is attracted to the conveying belt 50 is electrostatic force. In order to charge the conveying belt 50, which provides the above electrostatic force, electric charge may be given to the conveying belt 50 by supplying a current to the attracting roller 151.

The sheet P which has been conveyed from the feeding portion 20 can be attracted onto the conveying belt 50 by supplying a current to the attracting roller 151. However, when enough static electricity is given to the conveying belt by the transfer rollers 16*a* through 16*d*, the electrostatic force of the attracting roller 151 is not necessarily required.

Moreover, when the discharging power is given to the suspending roller 154, stable fixing may be obtained because discharging is done before fixing. Furthermore, as the sheet P is discharged to the outside of the device, it becomes easier to separate the sheet P from the conveying belt 50. The discharging means is not a suspending member, but also there may be provided a discharging needle in contact with the surface of the sheet P. In particular, it becomes easier by providing the needle just after a nip between the fixing roller 61 and the pressing roller 62 to separate the sheet P from the conveying belt 50.

Usually, at rotation driving of the endless conveying belt 50, a belt slippage occurs in which a belt advances in a direction orthogonal to the direction of the rotation. As general adjustment measures for belt slippage, for example, there are a method, by which belt slippage is required by providing a rib on a belt, a method by which belt slippage is regulated by providing a flange as a suspending member, or a method by which the belt slippage is adjusted by providing a belt slippage detecting means and by adjusting the alignment of the suspending members. The belt slippage can be adjusted by any of the above method.

A tension means giving tension to the conveying belt 50, a static-electricity giving means which attracts the sheet P onto the conveying belt 50, and the number and the arrangement positions of suspension members having the above functions, which have been described above, are not limited to the types described in the present embodiments. Moreover, a discharging means removing charges on the conveying belt 50, or the sheet P, the belt slippage regulating means of the conveying belt 50, and the number and the arrangement positions of the suspending members having the above functions are not limited by the present embodiments. Moreover, though there has been shown an example in which the suspending members are arranged on the inner periphery of the conveying belt 50, the members may be arranged on an outer periphery of the conveying belt 50.

Moreover, the cleaner 70 as the cleaning member of the conveying belt 50 is preferably arranged at a position to which the sheet P is not conveyed, as shown in FIG. 7. As the position in FIG. 7 is within a region in which the sheet P is not conveyed by the conveying belt 50, cleaning of the conveying belt 50 can be performed without detaching the cleaner 70, and in a state in which the cleaner 70 is in contact with the conveying belt 50 all the time.

The driving source for the fixing portion 60 is used as the driving source of the conveying belt 50. As the conveying belt 50 is sandwiched between the fixing roller 61 and the pressing roller 62, the conveying belt 50 is also rotated by rotating the fixing roller 61.

Figure 9:
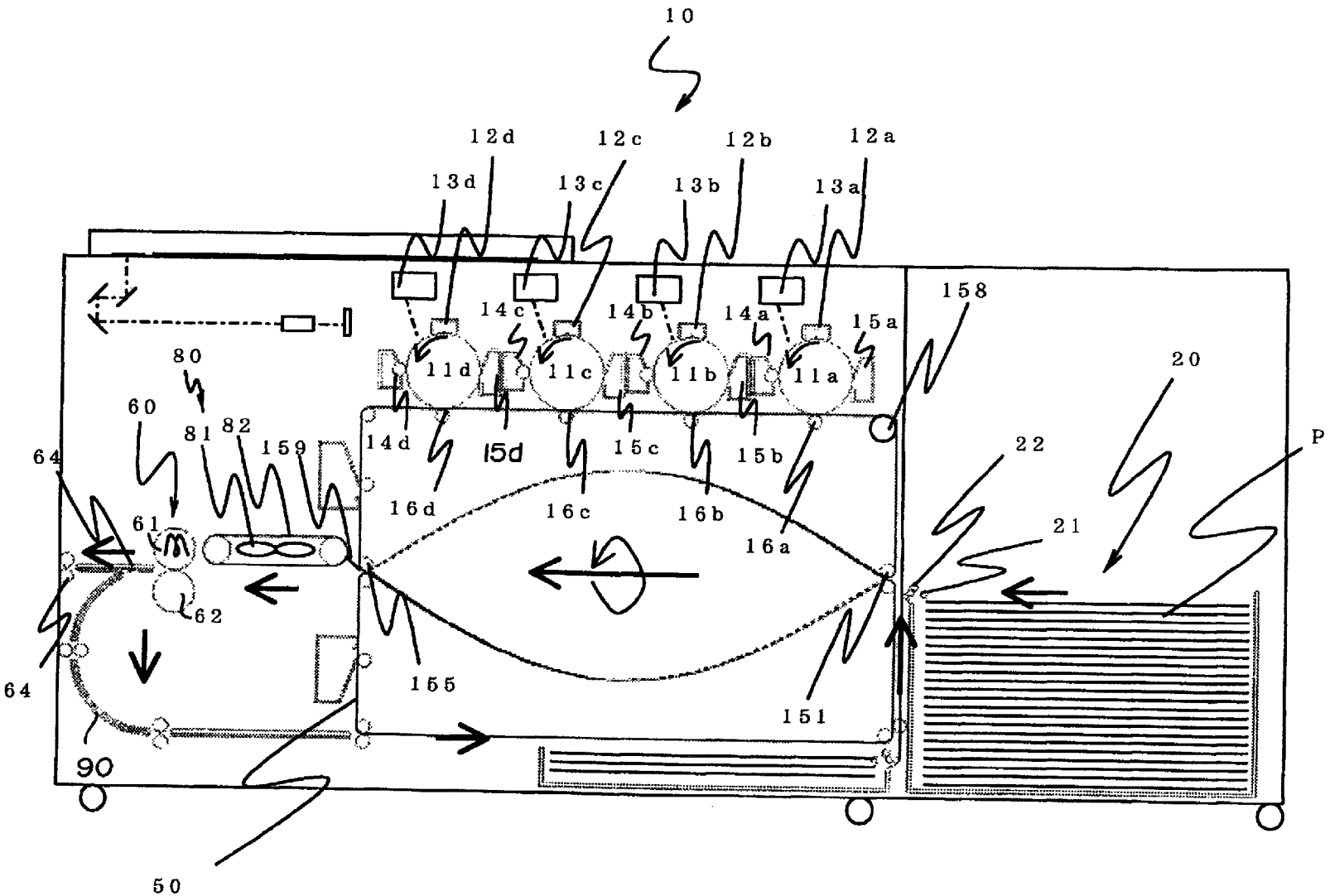
FIG. 9 is a longitudinal view of an image forming apparatus according to another embodiment of the present invention.
Figure 10:
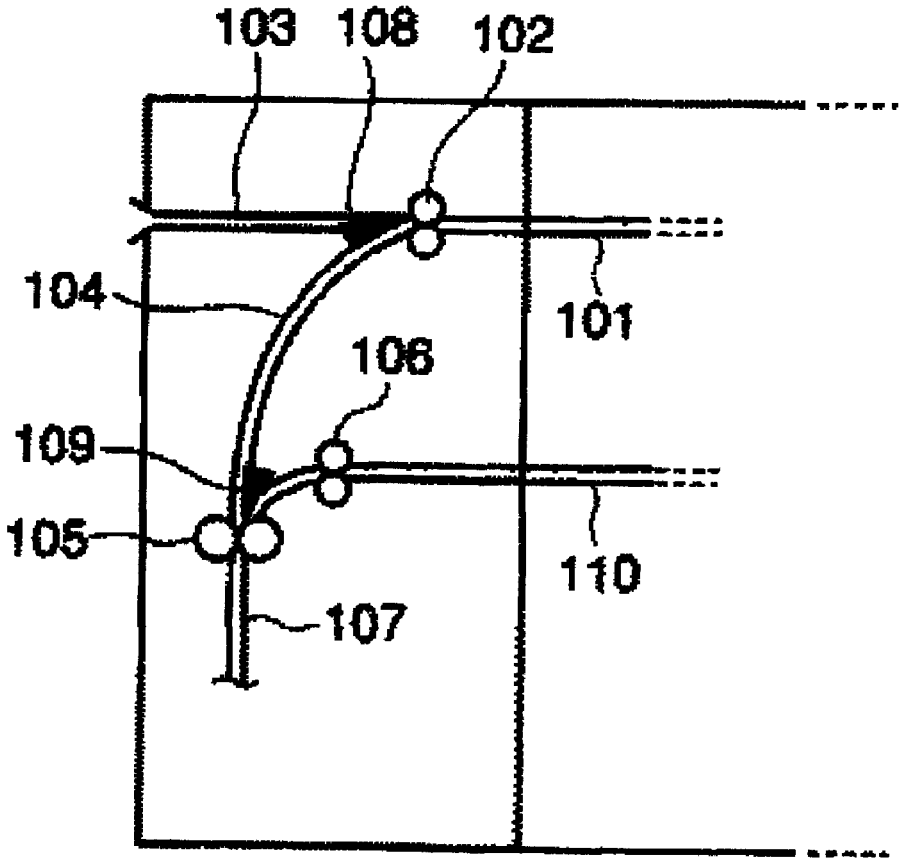
FIG. 10 PRIOR ART
FIG. 10 is a side view of a sheet turning over portion in a conventional image forming apparatus.
Figure 11:
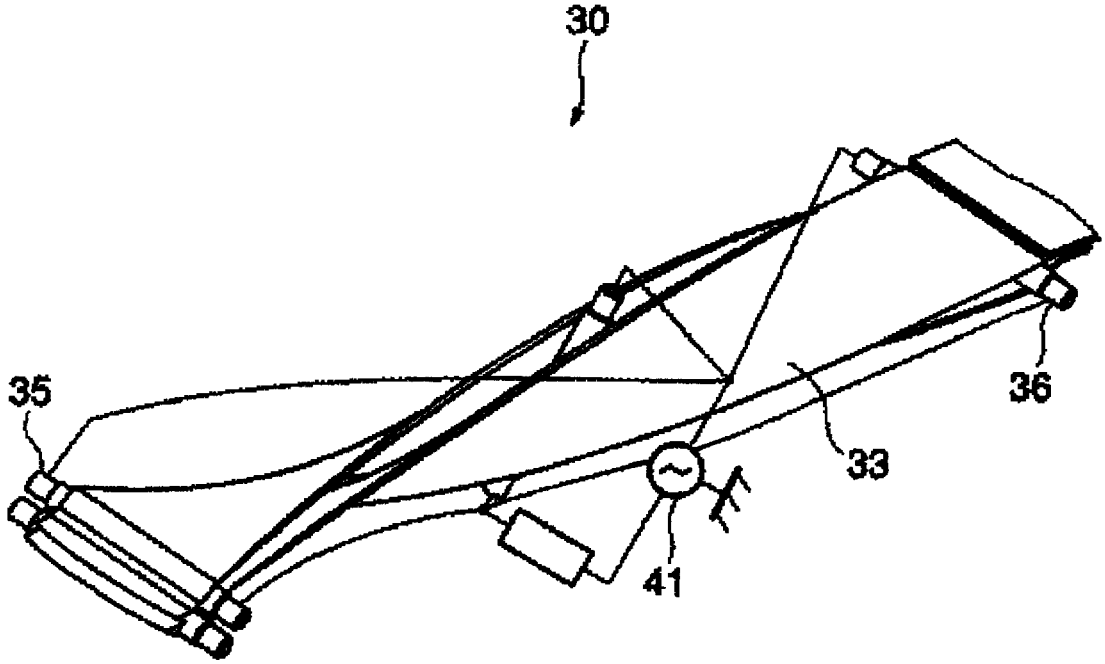
FIG. 11 PRIOR ART
FIG. 11 is a perspective view of a sheet turning over portion in another conventional image forming apparatus.

As described above, the present embodiment has shown examples in which the fixing roller 61 is used as a driving source of the conveying belt 50. But, as shown in FIG. 9, the driving roller 158, in addition to the fixing roller 61, maybe arranged as a driving source. In that case, the sheet P is attracted from the lower belt to the upper belt by the suspending roller 155, and, at the same time, a toner image is transferred onto the sheet P.

Then, the sheet is separated from the conveying belt 50 by a separation means 159, and is conveyed by the before-fixing conveying portion 80. The before-fixing conveying portion 80 has a fan 81 and a conveying belt 82. The non-toner transfer side of the sheet P is attracted to the conveying belt 82 by the fan 81, and the sheet P is conveyed to the fixing portion 60. During both-side printing, the sheet P is configured to pass the bending path 90 by the switching member 65 after passing the fixing portion 60, and to be attracted again onto the conveying belt 50. Even in this case, it is possible to obtain the advantage of a smaller device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-234867, filed Sep. 11, 2007, which is hereby incorporated by reference herein in its entirety.

What is claimed is:

1. An image forming apparatus comprising:

an endless conveying belt configured to convey a sheet on which an image is to be formed by rotation of the conveying belt;

a plurality of suspending members suspending the conveying belt in a figure of eight arrangement; and an image forming portion that forms an image on the sheet conveyed by the conveying belt, wherein the conveying belt includes:

a twist of 720 degrees, a flat region in which the conveying belt is not twisted and configured to convey the sheet, a twisted region in which the conveying belt is twisted and configured to convey the sheet with a first major surface touching a first part of the conveying belt, wherein the image forming apparatus is configured to transfer the sheet to a further part of the conveying belt facing the first part so that a second major surface, which is opposite the first major surface of the sheet, is in contact with the further part of the conveying belt, and wherein the image forming portion is disposed to face the flat region, and wherein the image forming portion forms a first image onto the first major surface of the sheet in the flat region, and a second image onto the second major surface of the sheet in the flat region after turning over, in the twisted region, the sheet formed with the first image.

2. The image forming apparatus according to claim 1, wherein the conveying belt is configured to convey the sheet in a state where the conveying belt is kept in contact with the sheet from a starting of the first image onto the first major surface of the sheet to an ending of the first image onto the second major surface of the sheet.

3. The image forming apparatus according to claim 1, wherein the conveying belt forms a ring-like conveying path for performing:

transfer conveying, by which an image is transferred onto the sheet, fixing conveying, by which the image transferred onto the sheet is fixed, turning over conveying, by which the sheet is turned over, and re-conveying, by which the turned over sheet is conveyed again.

4. The image forming apparatus according to claim 1, wherein at least one of the plurality of suspending members is provided with an adjustment, device configured to adjust belt slippage generated in a direction orthogonal to the rotation direction of the conveying belt.

5. The image forming apparatus according to claim 1, wherein at least one of the plurality of suspending members is operable to supply electric charges to the conveying belt.

6. The image forming apparatus according to claim 1, wherein at least one of the plurality of suspending members is operable to discharge electric charges on the conveying belt.

7. The image forming apparatus according to the claim 1, further comprising:

a separation portion, disposed between the flat region and the twisted region, that separates the sheet from the conveying belt, wherein the separation portion is switchable between a first status to release the sheet from the conveying belt and a second status not to release the sheet from the conveying belt.

* * * * *